US005802984A

United States Patent [19]

Thoman et al.

[11] Patent Number: 5,802,984

[45] **Date of Patent: *Sep. 8, 1998**

[54] LOAD DIVIDER ASSEMBLY AND DOOR ASSEMBLY FOR A COMPOSITE RAILWAY BOXCAR

[75] Inventors: Mell R. Thoman, Carrollton; John W. Coulborn, Fort Worth, both of Tex.

[73] Assignee: Trinity Industries, Inc., Dallas, Tex.

[ * ] Notice: This patent issued on a continued prosecution application filed under 37 CFR 1.53(d), and is subject to the twenty year patent term provisions of 35 U.S.C. 154(a)(2).

[21] Appl. No.: 684,537

[22] Filed: Jul. 19, 1996

Related U.S. Application Data

[60] Provisional application No. 60/001,346, Jul. 21, 1995 and provisional application No. 60/001,348 Jul. 21, 1995 and provisional application No. 60/001,347 Jul. 21, 1995.

[51] Int. Cl.[6] ..... B61D 17/00

[52] U.S. Cl. ..... 105/404; 105/355; 105/409; 105/413; 105/423

[58] Field of Search ..... 105/355, 396, 105/397, 410, 401, 402, 404, 409, 413, 416, 417, 418, 419, 422, 423; 296/900, 901, 183, 181, 39.3, 24.1; 410/129, 130–140; 220/1.5, 4.01, 4.21, 645

[56] References Cited

U.S. PATENT DOCUMENTS

| | | |
|---|---|---|
| 709,894 | 9/1902 | Ferrell . |
| 1,133,335 | 3/1915 | Summers . |
| 1,170,129 | 2/1916 | Weaver . |

(List continued on next page.)

FOREIGN PATENT DOCUMENTS

| | | | |
|---|---|---|---|
| 232242 | 6/1959 | Australia | 105/397 |
| 145249 | 12/1980 | Germany | 105/401 |
| 3911138 | 10/1990 | Germany . | |

OTHER PUBLICATIONS

Co–pending application entitled *Insulated Composite Railway Boxcar and Method* filed concurrently (Attorney's Docket 091078.0444).

Co–pending application entitled *Composite Box Structure for a Railway Boxcar Boxcar* filed concurrently (Attorney's Docket 091078.0446).

(List continued on next page.)

*Primary Examiner*—Mark T. Le
*Attorney, Agent, or Firm*—Baker & Botts, L.L.P.

[57] ABSTRACT

A composite railway boxcar having a composite box structure mounted on a railway car underframe is provided. The composite box structure includes side walls, end walls and a floor molded as an integral unit with fiber reinforced plastic interior and exterior surfaces. The composite box structure includes a roof mounted on the side walls and the end walls opposite from the floor. An upper load divider track assembly is provided having a pair of tracks with each track disposed between the roof and one of the side walls. A lower load divider track assembly is also provided having a track disposed within the interior of each side wall above the floor. A composite load divider panel is slidably mounted on the upper load divider track assembly within the interior of the railway boxcar. The load divider panel is releasably secured to the lower load divider track assembly to allow varying the position of the load divider panel within the interior of the railway boxcar. Each side wall includes an opening with a door mounted on the opening to control access to the interior of the railway boxcar and to provide a thermal barrier between the interior and the exterior of the boxcar.

23 Claims, 6 Drawing Sheets

U.S. PATENT DOCUMENTS

| | | | |
|---|---|---|---|
| 1,749,473 | 3/1930 | Des Islets . | |
| 2,620,226 | 12/1952 | Jones | 298/27 |
| 2,635,559 | 4/1953 | Nystrom et al. | 105/416 |
| 2,783,718 | 3/1957 | Cheshire | 105/419 |
| 2,788,750 | 4/1957 | Priest | 105/406 |
| 3,057,284 | 10/1962 | Learmont | 410/135 |
| 3,100,458 | 8/1963 | Baker et al. | 105/397 |
| 3,175,520 | 3/1965 | Talmey | 105/409 |
| 3,252,430 | 5/1966 | Eckhardt et al. | 105/397 |
| 3,266,441 | 8/1966 | Pulcrano | 105/416 |
| 3,563,403 | 2/1971 | Luisada | 220/1.5 |
| 3,599,575 | 8/1971 | Yurkoski et al. | 105/358 |
| 3,616,764 | 11/1971 | Johnson et al. | 105/366 |
| 4,076,166 | 2/1978 | Austill | 228/157 |
| 4,209,892 | 7/1980 | Hofstaedter et al. | 105/401 |
| 4,226,189 | 10/1980 | Bertolini | 105/423 |
| 4,230,048 | 10/1980 | Gordon et al. | 105/248 |
| 4,275,662 | 6/1981 | Adler et al. | 105/377 |
| 4,286,507 | 9/1981 | Dorpmund | 98/32 |
| 4,292,898 | 10/1981 | Gordon et al. | 105/238 |
| 4,422,558 | 12/1983 | Mittelmann et al. | 220/1.5 |
| 4,469,541 | 9/1984 | Goldsworthy | 156/180 |
| 4,474,632 | 10/1984 | Spees | 156/78 |
| 4,497,258 | 2/1985 | Ruhmann et al. | 105/248 |
| 4,498,941 | 2/1985 | Goldsworthy | 156/148 |
| 4,608,931 | 9/1986 | Ruhmann et al. | 105/248 |
| 4,902,215 | 2/1990 | Seemann, III | 425/406 |
| 4,904,017 | 2/1990 | Ehrlich | 296/181 |
| 4,998,637 | 3/1991 | Marovskis | 220/1.5 |
| 5,042,395 | 8/1991 | Wackerle et al. | 105/397 |
| 5,050,402 | 9/1991 | Graaff | 62/457.9 |
| 5,052,906 | 10/1991 | Seemann | 425/112 |
| 5,114,516 | 5/1992 | Pilling et al. | 156/180 |
| 5,168,717 | 12/1992 | Mowatt-Larssen | 62/239 |
| 5,201,432 | 4/1993 | Jensen | 220/1.5 |
| 5,246,321 | 9/1993 | Hesch | 410/58 |
| 5,255,806 | 10/1993 | Korzeniowski et al. | 220/1.5 |
| 5,265,748 | 11/1993 | Furukawa | 220/1.5 |
| 5,299,405 | 4/1994 | Thompson | 52/795 |
| 5,316,462 | 5/1994 | Seemann | 425/112 |
| 5,320,046 | 6/1994 | Hesch | 105/413 |
| 5,362,345 | 11/1994 | Stettler et al. | 105/397 |
| 5,370,482 | 12/1994 | Long | 410/153 |
| 5,373,792 | 12/1994 | Pileggi et al. | 105/406 |
| 5,383,406 | 1/1995 | Vanolo et al. | 105/401 |
| 5,386,674 | 2/1995 | Sfirakis et al. | 52/243.1 |
| 5,392,717 | 2/1995 | Hesch et al. | 105/404 |
| 5,403,062 | 4/1995 | Sjostedt et al. | 296/181 |
| 5,403,063 | 4/1995 | Sjostedt et al. | 220/1.5 |
| 5,449,081 | 9/1995 | Sjostedt et al. | 220/1.5 |
| 5,450,977 | 9/1995 | Moe | 220/1.5 |
| 5,458,066 | 10/1995 | Ishida et al. | 105/397 |
| 5,601,034 | 2/1997 | Tao et al. | 105/423 |
| 5,690,378 | 11/1997 | Romesburg | 296/181 |

OTHER PUBLICATIONS

Co–pending application No. 08/859,671 entitled *Insulated Composite Railway Boxcar and Method* filed May 20, 1997 (Attorney's Docket 091078.0587).

Co–pending application No. 08/859,575 entitled *Insulated Composite Railway Boxcar Underframe* filed May 20, 1997 (Attorney's Docket 091078.0588).

Co–pending application entitled *Railway Car Underframe for an Insulated Composite Boxcar* filed Dec. 5, 1997 (Attorney's Docket 091078.0650).

Shippers' Problems . . . Trinity's Solution!, Trinity Industries, Inc. advertisement, no date.

"Trinity Steel Box Car Key Features", specification sheeet, no date.

Letter from American Composite Inc., Aug. 27, 1997.

List of products from American Composite Inc., no date.

G. Welty "New Designs, New Materials, Freight Cars", Railway Age, Feb. 1994, p. 29.

M. Gabriele, "Pultrusions's Promise", Plastics Technology, Mar. 1995, p. 36.

"FRP Goes After Intermodal Container Market", Plastics World, Oct. 1993, p. 16.

Brochure, "Stoughton Composites, Inc. Introduces 'Lightweight Refrigerated Domestic Containers'", Stoughton Composites, Dec. 1993, pp. 1–10.

Drawing, "Car Body Assembly" Graaff GmbH, May 1994, p. 1.

Catalogue Item, "Durashield® Foam Core Building Panels", Ryerson Plastics Catalogue No. 21, 1992, p. 112.

Single Page: "Freight Cars: Mechanical Refrigerator." Pacific Fruit Express, p. 135. (no date).

Manual: "Equipment Diagram for Unrestricted Interchange Service." Association of American Railroads Mechanical Division, Aug. 1991, pp. C–249—C–256.2.

Article: "A better boat, a greener boatworks." Sail Magazine, Aug. 1993, pp. 27–29.

Brochure: "Simply . . . Making it Easier to Ship Your Frozen Foods." General American Transportation Corporation. (no date).

Brochure: "Scrimp Systems . . . Composite performance and quality." Dupont, Delaware Technology Park. (no date).

Catalog pages from General American Transportation Corporation on GATX ARTICAR (8 pages). (no date).

Catalog pages from Stoughton Composites, Inc. on Domestic Container (5 pages). (no date).

Catalog pages from Pullman–Standard, Division of Pullman Incorporated, on Foamed–in–Place Insulated Box Cars (5 pages). (no date).

Catalog pages from Pacific Car and Foundry Company (19 pages). (no date).

Catalog page on C.H. Robinson 48–foot domestic container. (no date).

Catalog pages from Graaff GmbH on "Sandwich Technology for Refrigerated and Insulated Transport Equipment" May 1994 (9 pages).

Miscellaneous pages from *Introduction to Composites on Constituents of Composites* (20 pages). (no date).

LOAD DIVIDER ASSEMBLY AND DOOR ASSEMBLY FOR A COMPOSITE RAILWAY BOXCAR

RELATED APPLICATIONS

This application claims the benefit of U.S. Provisional Application No. 60/001,348, filed Jul. 21, 1995; U.S. Provisional Application No. 60/001,347, filed Jul. 21, 1995 and U.S. Provisional Application No. 60/001/346, filed Jul. 21, 1995.

This application is related to co-pending application entitled Insulated Composite Railway Boxcar and Method, filed on Jul. 19, 1996, Ser. No. 08/684,345, allowed, and co-pending application entitled Composite Box Structure for a Railway Boxcar, filed on Jul. 19, 1996, Ser. No. 08/684,564, pending.

TECHNICAL FIELD OF THE INVENTION

This invention relates generally to composite railway boxcars and more particularly to a load divider system and door assembly for a composite box structure which may be used in the manufacture of composite railway boxcars.

BACKGROUND OF THE INVENTION

Over the years, general purpose railway boxcars have progressed from relatively simple wooden structures mounted on flat cars to more elaborate arrangements including insulated walls and refrigeration equipment. Various types of insulated railway boxcars are presently manufactured and used. A typical insulated railway boxcar includes an enclosed structure mounted on a railway car underframe. The enclosed structure generally has an outer shell, one or more layers of insulation and interior paneling. The outer shell of such railway boxcars often has an exterior surface formed from various types of metal such as steel or aluminum. The interior paneling is often formed from wood and/or metal as desired for the specific application. For some applications the interior paneling has been formed from fiber reinforced plastic (FRP). Various types of sliding doors including plug type doors are generally provided on each side of conventional railway boxcars for loading and unloading freight. Conventional railway boxcars are assembled from various pieces of wood, steel and/or sheets of composite materials such as fiberglass reinforced plastic. Significant amounts of raw material, labor and time are often required to complete the manufacture and assembly of conventional railway boxcars.

The underframe for many railway boxcars include a center sill with a pair of end sills and a pair of side sills arranged in a generally rectangular configuration corresponding approximately with the dimensions for the floor of the railway boxcar. Cross bearers and cross ties are provided to establish the desired rigidity and strength for transmission of vertical loads from the side sills to the center sill and for dissipating horizontal end loads on the center sill to other portions of the underframe. A plurality of longitudinal stringers are also provided on each side of the center sill to support the floor of the enclosed structure. Examples of such railway car underframes are shown in U.S. Pat. Nos. 2,783,718 and 3,266,441.

For many years various techniques have been used to build fiberglass boat hulls. Many of these hulls have been fabricated using wet layup techniques in which each layer of material such as fiberglass or carbon fiber is first wetted with the desired resin such as polyester or vinylester and then laid in an open mold. Recently, vacuum bagging techniques have been combined with wet layup techniques to control the emission of volatile organic compounds. Vacuum bagging also produces a stronger structure by eliminating air pockets and excess resin in the finished product.

More recently, vacuum bagging techniques have been combined with an enhanced resin delivery system which allows the use of a closed molding system and dry layup of core layers and fiber reinforcing layers such as fiberglass in the mold. This process may sometimes be referred to as composite resin infusion molding. U.S. Pat. Nos. 4,902,215; 5,052,906 and 5,316,462 provide additional information concerning this type of vacuum bagging process to form a fiberglass reinforced composite article.

Various types of load dividers and freight securing systems have previously been used to prevent undesired movement of freight contained within a railway boxcar. The use of such systems is particularly important when a railway boxcar is only partially loaded. Examples of such systems are shown in U.S. Pat. No. 5,370,482 entitled "Cargo Securement System" and U.S. Pat. No. 5,386,674 entitled "Two Piece Bulkhead Door for Rail Cars and the Like." All patents noted in the Background of the Invention are incorporated by reference for all purposes within this application.

SUMMARY OF THE INVENTION

In accordance with the present invention, disadvantages and problems associated with previous insulated railway boxcars have been substantially reduced or eliminated. The present invention provides a composite box structure for a railway boxcar having enhanced insulation, reduced railway weight and increased service life as compared to a typical boxcar. Also, a composite box structure incorporating teachings of the present invention allows alignment of an upper load divider track assembly with a lower load divider track assembly to ensure satisfactory performance of the resulting load divider system. A lightweight composite door may be formed from the same materials as the composite box structure to further provide enhanced insulation and reduced maintenance costs for the resulting railway boxcar.

One aspect of the present invention includes a composite box structure having a pair of side walls, end walls and a floor fabricated as a single unit using vacuum bagging techniques and dry layup of selected material layers along with an enhanced resin delivery system. During the molding process, openings are provided in the side walls corresponding with the desired location of doors for controlling access to the resulting railway boxcar. A roof may be molded using the same materials and techniques as the side walls, end walls and floor, to function as a structural supporting member for the resulting railway boxcar. As a result, the door opening may be substantially increased in size as compared to conventional railway boxcars due to the structural support provided by the molded roof.

Technical advantages of the present invention include providing a composite box structure having completely flush interior and exterior surfaces with no seems or metal posts at the corners of the enclosed structure. Internal supporting beams may be formed within the side walls from the same composite materials used to form the composite box structure. The floor has a completely flushed interior surface with no seems or joints.

Further technical advantages of the present invention include a composite box structure having substantially reduced heat transfer characteristics. Resistance to heat transfer is further enhanced by eliminating metal connections extending through the composite box structure. Supporting brackets and mechanical fasteners associated with the load divider system and the doors of the railway boxcar are insulated from the surrounding environment by a foam core and/or multiple layers of fiber reinforced plastic.

One aspect of the present invention includes an opening formed in each side wall of a composite box structure with a metal reinforcing frame mounted on portions of the composite box structure adjacent to each opening. By increasing the width of the opening for each door and the resulting distance between the door posts or vertical frame members, the length of the railway car can be increased while meeting the same AAR plate requirement. Portions of the composite box structure adjacent to each opening are chamfered and provide an offset to receive an associated sliding plug door. The chamfer and offsets along with the metal reinforcing frame and associated plug door cooperate to allow increasing the length of the resulting railway boxcar as compared to a conventional insulated boxcar meeting the same AAR plate requirements.

BRIEF DESCRIPTION OF THE DRAWINGS

For a more complete understanding of the present invention, and the advantages thereof, reference is now made to the following written description taken in conjunction with the accompanying drawings, in which.

DETAILED DESCRIPTION OF THE INVENTION

The preferred embodiments of the present invention and its advantages are best understood by referring to FIGS. 1A through 14 of the drawings, like numerals being used for like and corresponding parts of the various drawings.

Figure 1A:
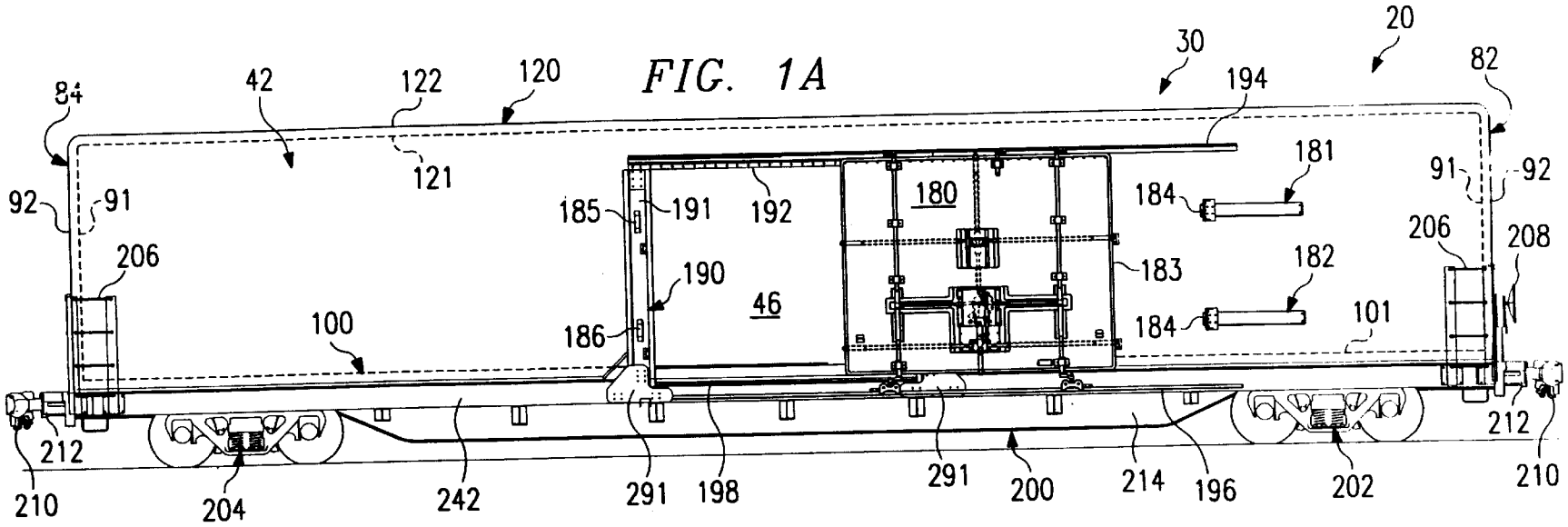
FIG. 1A is a schematic drawing in elevation showing a side view of a railway boxcar having a composite box structure and a railway car underframe incorporating one embodiment of the present invention.
Figure 1B:
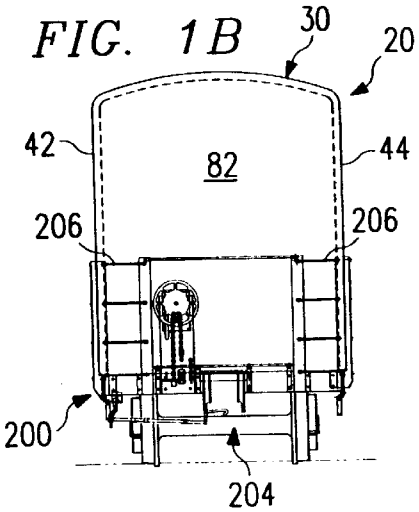
FIG. 1B is an end view of the railway boxcar of FIG. 1A.

Insulated composite railway boxcar 20 incorporating teachings of the present invention is shown in FIGS. 1A and 1B with composite box structure 30 mounted on railway car underframe 200. Composite box structure 30 is preferably both adhesively bonded and mechanically coupled with railway car underframe 200. For the embodiment of the present invention shown in FIGS. 1A and 1B, railway boxcar 20 has exterior dimensions which satisfy the requirements of Plate C and associated structural design requirements of the Association of American Railroads (AAR). Forming composite box structure 30 from light weight composite materials in accordance with teachings of the present invention allows a reduction in the weight of railway boxcar 20 while at the same time increasing both the internal volume and the load carrying capacity of railway boxcar 20 as compared to a conventional insulated boxcar within Plate C requirements.

For one application, composite box structure 30 has hollow interior 32 with dimensions of approximately sixty-eight feet in length, ten feet in width and twelve feet in height. For this application, railway boxcar 20 has a freight carrying capacity of approximately 6,291 cubic feet with a light weight of 86,000 pounds and a nominal load carrying capacity of 200,000 pounds which is very advantageous for an insulated railway boxcar satisfying the dimensional requirements of Plate C. Additional specifications for railway boxcar 20 are included at the end of this written description.

As a result of the present invention, composite box structure 30 may be modified to accommodate various geometric configurations based on specific customer requirements concerning the size and type of freight that will be carried in the resulting railway boxcar 20.

For purposes of this written description, the term "fiber reinforced plastic" is used to refer to composite materials composed of either a thermosetting or thermoplastic resin and fibers, filaments, or whiskers of materials such as glass, metal, aramid, boron, carbon, aluminum silicate and other suitable ceramic materials. For purposes of this patent application, the term "resin" is used to include both naturally occurring and synthetic polymers which may be mixed with various additives such as fillers, colorants, plasticizers, and curing agents, to infuse or impregnate the selected fiber material to form the desired fiber reinforced plastic layers and surfaces during fabrication of composite box structure 30. For one application the fiber material preferably includes glass fibers typically associated with FIBERGLAS® products available from Owens-Corning.

Composite box structure 30 preferably has a foam core wrapped with multiple plies of fiber material which has been infused with a selected resin to encapsulate the foam core with one or more layers of fiber reinforced plastic. The multiple plies of fiber material and the selected resin also form fiber reinforced plastic interior surfaces and exterior surfaces for composite box structure 30.

Composite box structure 30 is preferably fabricated using vacuum bagging techniques which include dry lay up of selected core materials and multiple layers of the selected fiber materials in a closed molding system (not shown) along with an enhanced resin delivery system (not shown). Some of the benefits of using a closed molding system include the ability to fabricate a large number of composite box structures 30 from the same mold with dimensions that meet the selected AAR plate requirements and at the same time provide both a smooth, aerodynamic exterior surface and a smooth, easily cleaned interior surface for the resulting railway boxcar 20.

The foam cores associated with composite box structure 30 may be formed from various types of material such as urethane, polyurethane, styrene and polystyrene. For some applications these foam cores may include light metal foam. Also, the foam cores may have various configurations such as foam blocks wrapped with one or more plies of selected fiber material or plies of a selected foam material alternating with plies of a selected fiber material.

Closed molding systems and enhanced resin delivery systems may be modified to form composite box structure 30 with various configurations and dimensions as required for the specific railway boxcar 20. U.S. Pat. Nos. 4,902,215; 5,052,906 and 5,316,462 show examples of vacuum bagging techniques satisfactory for use with the present invention. Composite resin infusion molding processes incorporating various features of these patents have been licensed to Hardcore DuPont Composites L.L.C. located at 42 Lukens Drive, New Castle, Del. Various types of composite structures molded in accordance with the teachings of these patents are available from Hardcore DuPont.

For some applications composite box structure 30 as shown in FIGS. 1A and 1B may be integrally molded as a single fiber reinforced composite unit with side walls 42 and 44, end walls 82 and 84, floor 100 and roof 120. For other applications as shown in FIGS. 4 through 14, composite box structure 30 is formed from first fiber reinforced composite unit 40 and second fiber reinforced composite unit or roof 120. By initially molding roof 120 as a separate composite unit, upper load divider track assembly 140 and lower load divider track assembly 170 may be installed and aligned with each other prior to permanently attaching second fiber reinforced composite unit 120 with first fiber reinforced composite unit 40. Other configurations for first fiber reinforced composite unit 40 and second fiber reinforced composite unit 120 may be satisfactorily used to fabricate railway boxcar 20 in accordance with the teachings of the present invention.

During the molding process generally rectangular openings 46 are formed in each side wall 42 and 44 intermediate the ends of the respective side walls 42 and 44. Doors 180 are slidably mounted on each side wall 42 and 44 adjacent to respective openings 46 for use in controlling access to interior 32 of railway boxcar 20. The height of each opening 46 preferably extends from floor 100 to the adjacent edge of roof 120. The center of each opening 46 corresponds approximately with the midpoint in the respective side wall 42 and 44. For one application each opening 46 has a height of approximately nine feet six inches which corresponds to the height of the respective side walls 42 and 44 between adjacent portions of floor 100 and roof 120.

Each door 180 has a first position blocking the respective opening 46 to form a thermal barrier between hollow interior 32 and the exterior of railway boxcar 20. Each door 180 also has a second position which allows access to hollow interior 32 of railway boxcar 20 through the respective opening 46. A pair of door stops 181 and 182 are preferably mounted on the exterior of each side wall 42 and 44 to limit the longitudinal movement of the respective door 180 from its first position to its second position. In FIG. 1A, door 180 is shown slidably mounted on upper track 194 and lower track 196 intermediate its first position which blocks opening 46 and its second position in which edge 183 of door 180 contacts respective door stops 181 and 182.

Various types of doors 180 may be satisfactorily used with the present invention. For the embodiment shown in FIGS. 1A and 13, each door 180 is preferably a "plug door". For some applications, door 180 may be a conventional plug door fabricated from steel and/or wood materials. For other applications, doors 180 are preferably fabricated from the same composite materials using the same molding techniques as first fiber reinforced composite unit 40 and second fiber reinforced composite unit 120. The use of composite materials eliminates corrosion and operating problems associated with heavy metal/wood doors which are typically installed on conventional railway boxcars.

As will be discussed later in more detail, each door 180 is preferably mounted on respective side walls 42 and 44 using presently available hardware such as operating pipes, operating mechanisms, rollers, locking bars, gears and cams associated with conventional railway boxcars. The various hardware items used to mount doors 180 on railway boxcar 20 may be obtained from several vendors including YSD Industries Incorporated (Youngstown Steel Door) located in 3710 Henricks Road, Youngstown, Ohio 44515 and Pennsylvania Railcar located at 584 Fairground Road, Mercer, Pa. 16137.

Figure 7:
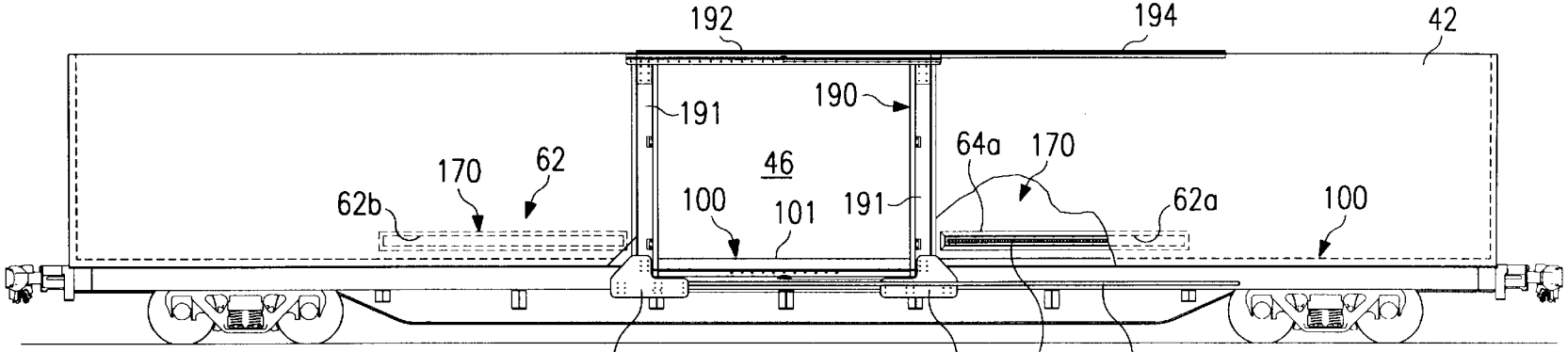
FIG. 7 is a schematic drawing in section and in elevation with portions broken away showing a lower load divider track assembly and a door frame assembly installed around the perimeter of an opening in the composite box structure of FIG. 1A in accordance with one embodiment of the present invention.

Railway car underframe 200, as shown in FIGS. 1A, 1B and 7 includes a pair of railway trucks 202 and 204 located adjacent to each end of railway boxcar 20. Safety equipment such as ladders 206 and hand brake 208 are attached to railway car underframe 200 with no connections or attachments to composite box structure 30. Standard railway couplings 210 are also provided on center sill 214 at each end of railway car underframe 200. End of car cushioning units 212 are preferably disposed between each end of center sill 214 and the respective coupling 210. Railway couplings and end of car cushioning units satisfactory for use with the present invention are available from various vendors including FM Industries, Inc. located at 8600 Will Rogers Blvd., Fort Worth, Tex. 76140 and Keystone Railway Equipment Company located at 3420 Simpson Ferry Road, Camp Hill, Pa. 17001-0456.

Railway car underframe 200 includes center sill 214 with a pair of end sills 282 and 284 and a pair of side sills 242 and 244 arranged in a generally rectangular configuration. The dimensions of the side sills 242 and 244 and end sills 282 and 284 correspond approximately with the dimensions associated with floor 100 of composite box structure 30. Railway car underframe 200 also includes a plurality of cross bearers 216 extending laterally between center sill 214 and the respective side sills 242 and 244. Railway car underframe 200 preferably includes a plurality of longitudinal stringers 230 extending parallel with center sill 214 and spaced laterally from each other between center sill 214 and the side sills 242 and 244.

Center sill 214, side sills 242 and 244, end sills 282 and 284 and longitudinal stringer 230 have respective surfaces which are disposed coplanar with each other. Portions of composite box structure 30 are preferably adhesively bonded or coupled with these coplanar surfaces. Loads placed on floor 100 within composite box structure 30 are transmitted through longitudinal stringers 230 onto cross bearers 216 and then to center sill 214.

One of the technical advantages of the present invention includes providing both adhesive bonding and mechanical coupling between composite box structure 30 and railway car underframe 200. A plurality of mechanical tie down connections (not expressly shown) are preferably attached to selected longitudinal stringers 230 for use in mechanically coupling composite box structure 30 with railway car underframe 200.

Side walls 42 and 44, end walls 82 and 84, floor 100, and roof 120 cooperate with each other to partially define hollow interior 32 of composite box structure 30. Hollow interior 32 corresponds with the interior of railway boxcar 20 in which various types of freight may be placed for shipment by railway boxcar 20. For one application, side walls 42 and 44, end walls 82 and 84 and floor 100 may be integrally molded with each other using vacuum bagging techniques to form first fiber reinforced composite unit 40. Similar molding techniques may be used to form second fiber reinforced composite unit or roof 120 and doors 180. For some applications side walls 42 and 44, end walls 82 and 84, floor 100 and roof 120 may be integrally joined with each other by molding as a single fiber reinforced composite unit in a closed molding system (not shown).

First layer 51 of fiber reinforced plastic is preferably formed on the interior surface of each side wall 42 and 44. Second layer 52 of fiber reinforced plastic is preferably formed on the exterior surface of each side wall 42 and 44. Each side wall 42 and 44 includes foam core 53 encapsulated between layers 51 and 52 of fiber reinforced plastic. In a similar manner first layer 91 of fiber reinforced plastic is preferably disposed on the interior of each end wall 82 and 84. Second layer 92 of fiber reinforced plastic is preferably disposed on the exterior of each end wall 82 and 84. Each end wall 82 and 84 preferably includes a foam core (not expressly shown) encapsulated between layers 91 and 92 of fiber reinforced plastic. Floor 100 preferably includes foam core 103 encapsulated between interior surface 101 and exterior surface 102 of fiber reinforced plastic. Roof 120 preferably includes foam core 123 encapsulated between layers 121 and 122 of fiber reinforced plastic.

As a result of the molding process, first layers 51, 91 and 101 provide a continuous, smooth interior surface of fiber reinforced plastic for railway boxcar 20. In a similar manner exterior surfaces 52, 92 and 102 are integrally molded with each other to form a continuous, smooth exterior surface of fiber reinforced plastic for railway boxcar 20. By installing load divider system 160 within side walls 42 and 44 in accordance with the teachings of the present invention, fiber reinforced plastic interior surface 101 of floor 100 has a generally smooth, continuous, flush surface with no indentations or openings.

The selected core and multiple plies of fiber material are placed in a closed molding system having the desired configuration for first composite unit 40, second composite unit 120, and/or door 180. A resin delivery system is used to infuse or impregnate the multiple plies of fiber material with the selected resin. Depending upon the intended application for the resulting railway boxcar 20, the fiber material may include carbon, boron, graphite, glass, aramid or a combination of these materials. Aramids such as KEVLAR® fibers and NOMEX® fibers available from E.I. DuPont DeNemours & Co. may be particularly useful in fabricating railway boxcars. Other fiber materials may be satisfactorily used with the present invention. Depending upon the intended application for railway boxcar 20, the resin may be selected from a wide variety of polymers including epoxy, polyester, vinylester and vinyl. Again, other resins may be satisfactorily used with the present invention.

For some applications, the cores associated with composite box structure 30 may be formed from a grid of selected foam material alternating with plies of the selected fiber material. The configuration of the layers of foam material and fiber material may be varied to provide the desired structural strength for the respective side walls 42 and 44, end walls 82 and 84, floor 100, roof 120 and/or door 180. The resulting grid (not expressly shown) of foam material and alternating plies of fiber material are preferably covered with one or more plies of fiber material and infused with the selected resin to form the corresponding interior surfaces 51, 91, 101, and 121 having at least one layer of fiber reinforced plastic and the corresponding exterior surfaces 52, 92, 102 and 122 also having at least one layer of fiber reinforced plastic with the grid of foam material and fiber reinforced plastic layers encapsulated therebetween. For one application end walls 82 and 84 have been formed with this grid configuration. U.S. Pat. No. 5,052,906 shows the use of multiple plies of fiber material and a grid type resin distribution system which may be satisfactorily used with the present invention.

By properly selecting the type of material used to form the foam cores along with other teachings of the present invention which substantially reduce or minimize potential heat transfer paths, composite box structure 30 may have a heat transfer rate of approximately one hundred sixteen (116) BTUs per hour per degree Fahrenheit or less. One of the technical advantages of the present invention includes the ability to select various types of foam and fiber materials and to vary the configuration of these materials to enhance both the structural and thermal performance of the resulting composite box structure 30.

Figure 2:
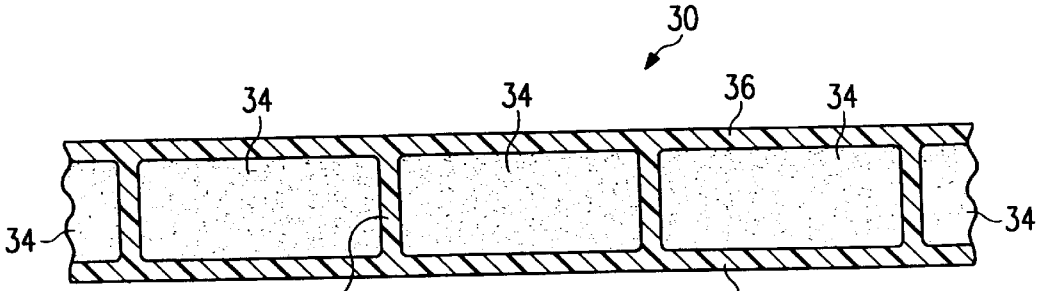
FIG. 2 is a schematic drawing showing a typical cross section of one portion of a composite box structure incorporating an aspect of the present invention.

FIG. 2 shows a typical cross section of composite box structure 30 having foam core 34 encapsulated in multiple layers of fiber reinforced plastic 36. Depending upon the specific application for the resulting railway boxcar 20, this cross section could represent side walls 42 and 44, end walls 82 and 84, floor 100, and/or roof 120. Doors 180 and load divider panels 162 may also be molded from composite materials with a similar cross section.

The portion of composite box structure 30 shown in FIG. 2 has been formed by wrapping a plurality of foam blocks 34 with selected fiber material. Foam blocks 34 are then placed in a closed mold between a first ply of fiber material and a second ply of fiber material. For some applications multiple plies of fiber material may be used to wrap foam blocks 34 and multiple plies of fiber material disposed on what will eventually become the interior surface and the exterior surface of composite box structure 30.

The fiber material wrapped on foam blocks 34 along with the first and second plies of fiber material are then impregnated with the selected resin to form a continuous web of fiber reinforced plastic layers 36 encapsulating foam blocks 34. For some applications foam blocks 34 may be coated or treated to prevent foam blocks 34 from absorbing or being infused with the selected resins. Material other than foam blocks 34 may be used to form the cores.

Figure 3:
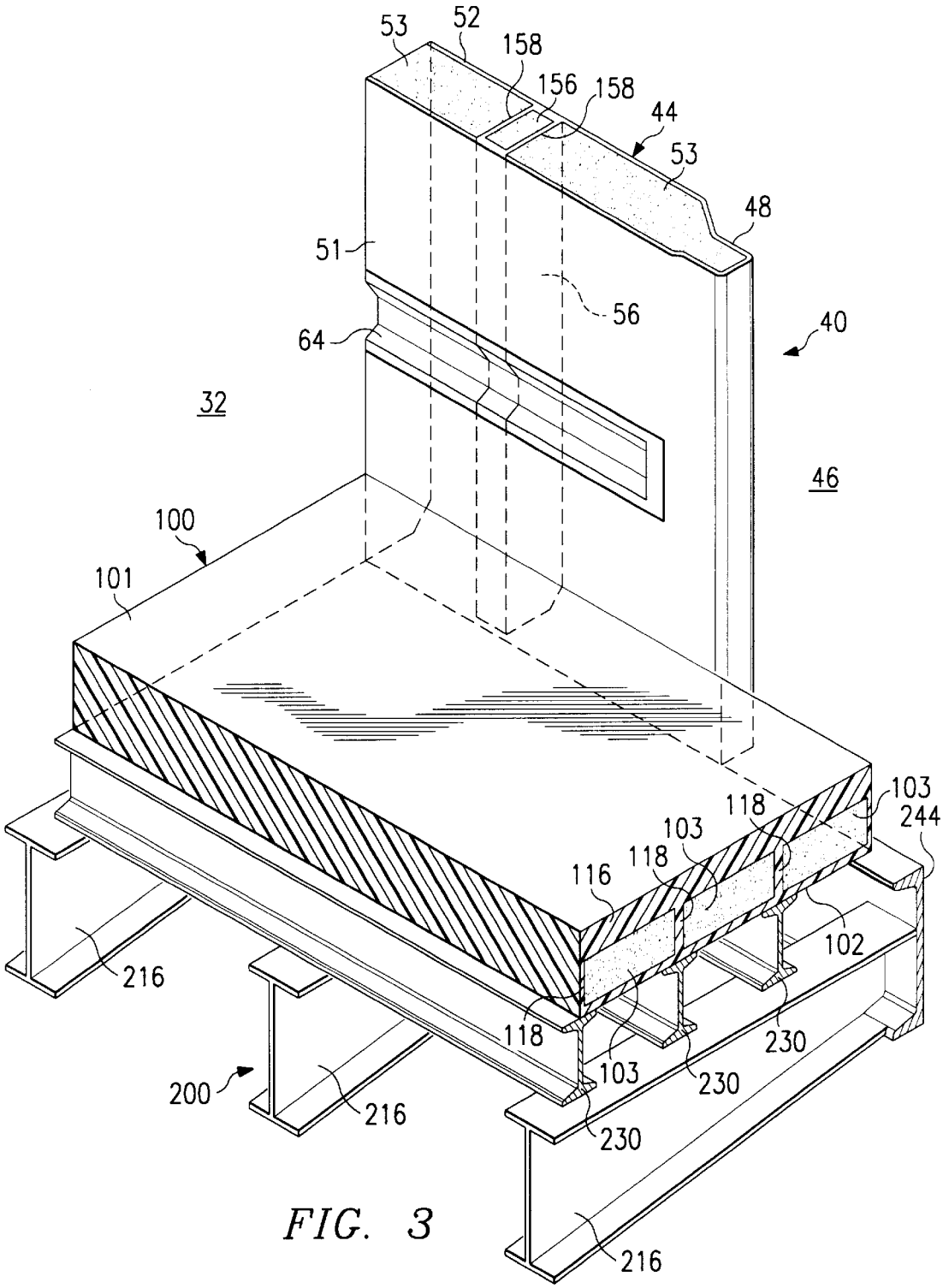
FIG. 3 is an isometric drawing showing a schematic view of portions of a floor, side wall and railway car underframe adjacent to an opening in a composite box structure incorporating the teachings of the present invention.

FIG. 3 is a schematic representation showing portions of composite box structure 30 mounted on railway car underframe 200. Sidewalls 42 and 44 are preferably formed from a plurality of foam blocks which have been wrapped with the selected fiber material and impregnated with the selected resin to form a continuous web of fiber reinforced plastic layers 158 between adjacent foam blocks and fiber reinforced plastic layers 51 and 52.

FIG. 3 shows a portion of side wall 44 and floor 100 adjacent to respective opening 46. Foam core 53 of side wall 44 (and also side wall 42) may have various configurations. For example, the thickness of foam core 53 is substantially reduced in portion 48 immediately adjacent to opening 46. The reduced thickness of section 48 and the increased spacing between vertical frame members 191 along with other features of the present invention including plug door 180 allows increasing the length of the resulting railway boxcar 20 as compared to conventional insulated railway boxcars meeting Plate C requirements.

Figure 9:
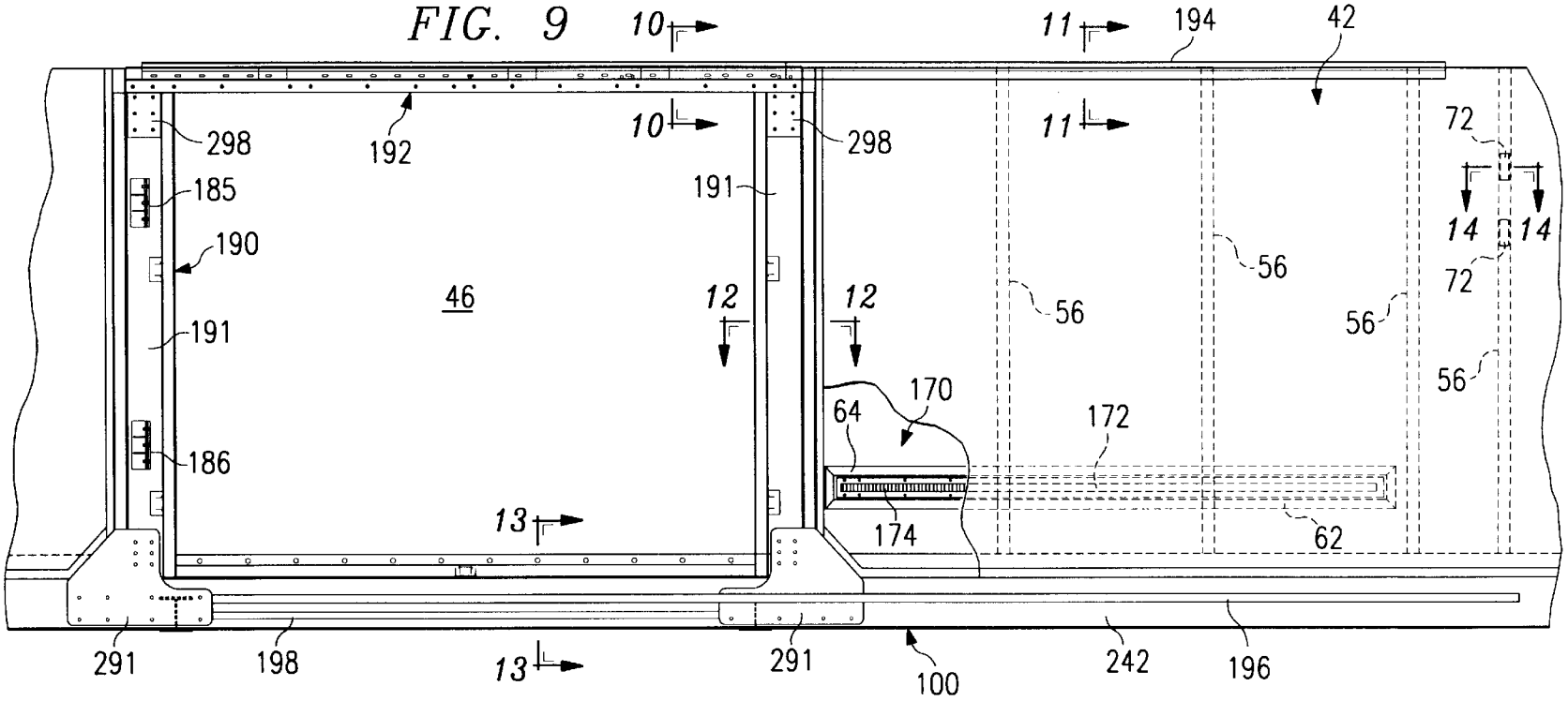
FIG. 9 is a schematic drawing in section and in elevation with portions broken away showing an enlarged view of portions of the lower load divider track assembly and door frame assembly installed around the perimeter of an opening in the composite box structure of FIG. 7.
Figure 14:
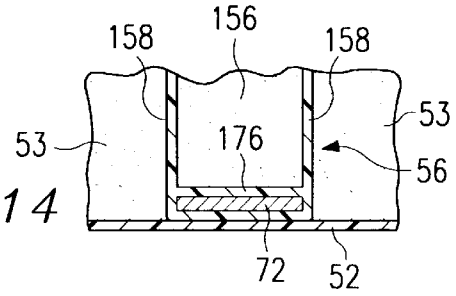
FIG. 14 is a schematic drawing in section with portions broken away showing a metal support plate or attachment plate molded within a vertical support beam taken along lines 14—14 of FIG. 9.

As shown in FIG. 3, alternating foam blocks 53 and 156 may be wrapped with fiber material and disposed adjacent to each other to form a section of side wall 44. Foam blocks 156 are preferably disposed vertically between adjacent foam blocks 53. This alternating arrangement of first foam blocks 53 and second foam blocks 156 provides vertical support beams 56 which substantially increases the strength of side walls 42 and 44. Infusing the fiber materials on the exterior of the foam blocks 53 and fiber material on the exterior of foam blocks 153 forms a continuous web of fiber reinforced plastic layers 158 extending vertically between interior surface 51 and exterior surface 52. Vertical support beams 56 are also shown in FIGS. 9 and 14. Two or more plies of fiber material may be used to form layers 51 and 52 adjacent to opening 46 to provide increased strength and wear resistance.

Floor 100 preferably includes a plurality of foam blocks 103 which have each been wrapped with one or more plies of fiber material (not expressly shown). During the molding process, blocks 103 are disposed adjacent to each other extending over the length and width of floor 100. This configuration results in vertical plies of fiber material being disposed between adjacent foam blocks 103 and extending longitudinally along the length of floor 100. At least one ply of fiber material is disposed on the interior portions of foam blocks 103. A second ply of fiber material is disposed on the exterior of foam blocks 103. For some applications, floor 100 could then be formed by infusing or molding the plies of fiber material with the selected resin. The resulting cross section for floor 100 would be similar to the cross section shown in FIG. 2.

The use of vacuum bagging techniques and dry layup of the selected core materials and multiple layers of the selected fiber material allow varying the cross section associated with floor 100 depending upon the specific application in which the resulting railway boxcar 20 will be used. For many applications, foam blocks 103 will not adequately carry compression and shear forces associated with placing heavy loads on interior surface 101 of floor 100. Thus, a layer of felt type material (not expressly shown) such as polyester is preferably placed on the first ply of fiber material along with two or more additional plies of fiber material. The configuration of felt type material and multiple plies of fiber material results in providing thick layer 116 of fiber reinforced plastic extending over the length and width of interior surface 101 of floor 100.

The width of foam blocks 103 is selected to be approximately equal to the distance between the center line of adjacent longitudinal stringers 230. Thus, vertical plies of fiber material are positioned within floor 100 during dry layup at a location corresponding approximately with the position of the respective longitudinal stringer 230 in railway car underframe 200. When the layers of fiber material are infused with the selected resin, the result is thick layer 116 of fiber reinforced plastic joined in a continuous web with vertical layers 118 of fiber reinforced plastic as shown in FIG. 3. As a result, any loads placed on interior surface 101 of floor 100 are transmitted through thick layer 116 of fiber reinforced plastic to vertical layers 118 of fiber reinforced plastic and the respective longitudinal stringer 230 to provide the desired load carrying capacity for floor 100.

As previously noted, one of the technical benefits of the present invention includes both adhesive bonding and mechanical coupling of composite box structure 30 with railway car underframe 200. A plurality of metal plates (not shown) are preferably wrapped with at least one ply of fiber material and integrally molded within floor 100 adjacent to exterior surface 102 between vertical layers 118 of fiber reinforced plastic for use in providing mechanical connections with railway car underframe 200. Various mechanical connections associated with load divider system 160 and door frame assembly 190 use this same molding technique to substantially reduce the transfer of thermal energy between the interior and the exterior of railway boxcar 20. Various types of brackets and/or mechanical fasteners (not expressly shown) may be provided as part of railway car underframe 200 adjacent to each metal plate disposed within floor 100.

Roof 120 has a generally rectangular configuration with a length corresponding approximately to the length of side walls 42 and 44 and the length of floor 100. The width of roof 120 corresponds approximately to the width of end walls 82 and 84 and the width of floor 100. Interior surface 121 of roof 120 preferably has a generally concave configuration and exterior surface 123 has a generally corresponding convex configuration. For some applications, flanges (not shown) are formed along longitudinal edges 125 and extend from interior surface 121. Each flange is sized to engage a portion of the interior surface of the respective side walls 42 and 44 when roof 120 has been attached to end walls 82 and 84 and side walls 42 and 44.

Various components associated with load divider system 160 are shown in FIGS. 3 through 11. These components include upper load divider track assembly 140, lower load divider track assembly 170 and load divider panel assembly 162 and carriage assembly 161. Conventional load divider systems are typically installed in a railway boxcar as separate individual pieces which may result in misalignment of tracks and other components associated with the load divider system. Various components associated with load divider system 160 may be obtained from several vendors including Youngstown Steel Door located in Youngstown, Ohio.

Figure 4:
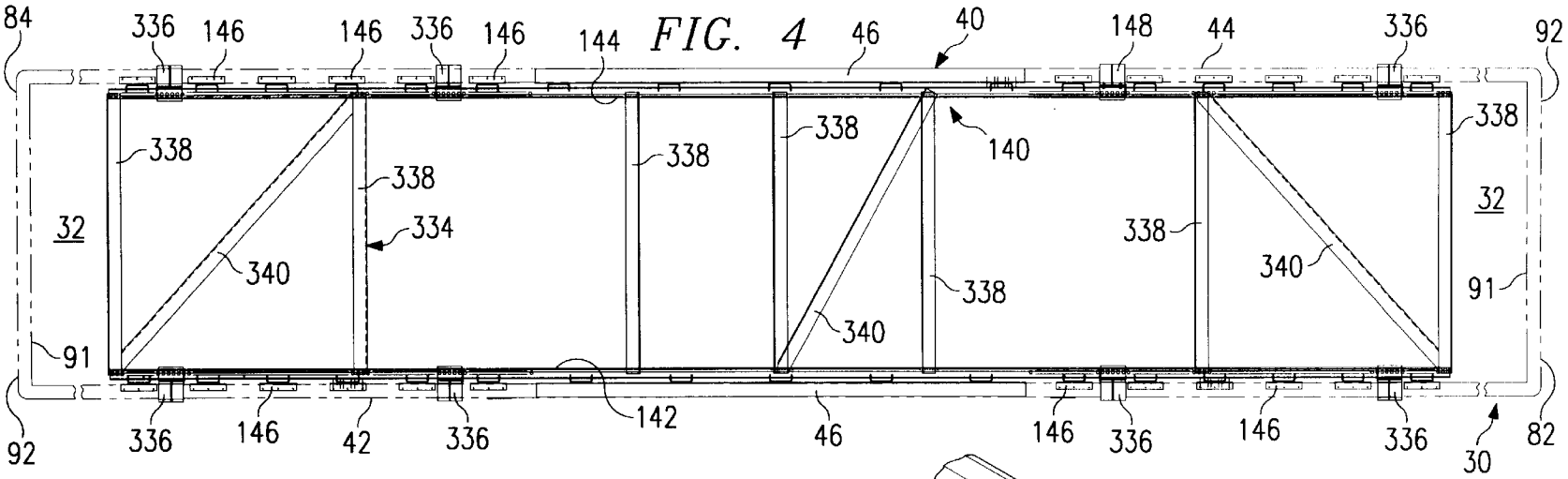
FIG. 4 is a schematic drawing showing a plan view of an upper load divider track assembly and temporary supporting jig mounted on opposite side walls of a composite box structure incorporating one embodiment of the present invention.
Figure 6:
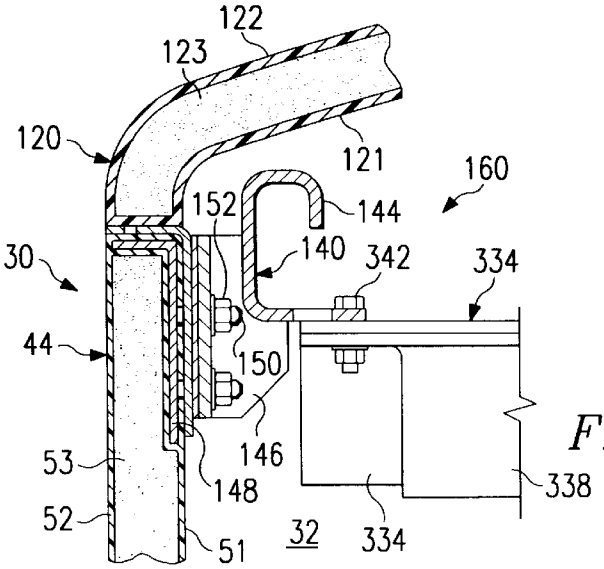
FIG. 6 is a drawing in section with portions broken away showing a section of an upper load divider track assembly and temporary supporting jig disposed between the roof and one of the side walls of the composite box structure of FIGURE lA.

As shown in FIG. 4, upper load divider track assembly 140 having a pair of tracks 142 and 144 may be releasably coupled with temporary supporting jig 334 to maintain the desired alignment of first track 142 with respect to second track 144. Temporary supporting jig 334 includes a plurality of lateral braces 338 and diagonal braces 340. A plurality of matching holes are formed in temporary supporting jig 334 and tracks 142 and 144 for use in releasably attaching upper load divider track assembly 140 to temporary supporting jig 334. Bolted connection 342 as shown in FIG. 6 is representative of the attachment between upper load divider track assembly 140 and temporary supporting jig 334.

Figure 5:
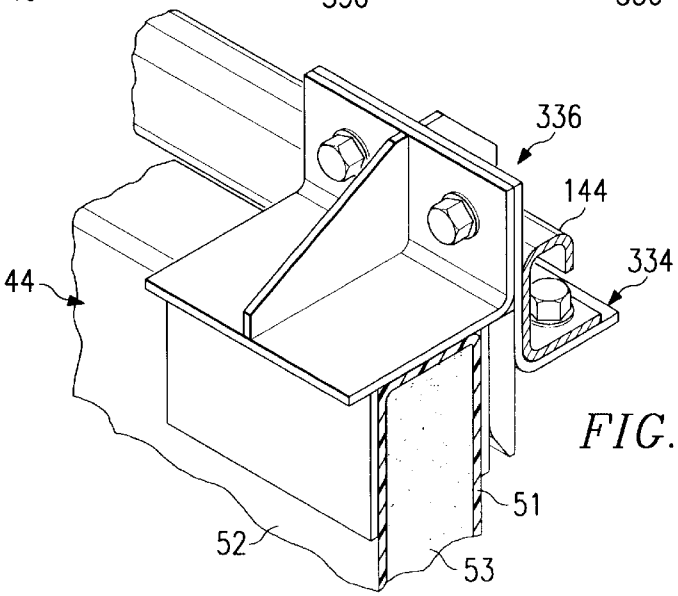
FIG. 5 is an isometric drawing with portions broken away showing a guide bracket temporarily disposed on the top portion of one of the side walls for use in installing the upper load divider track assembly of FIG. 4.

Lateral braces 338 and diagonal braces 340 cooperate with each other to maintain the desired alignment between tracks 142 and 144. Diagonal braces 340 may be used to apply tension and/or compression forces to upper load divider track assembly 140 during installation within first fiber reinforced composite unit 40. Guide brackets 336 are used to position temporary supporting jig 334 and upper load divider track assembly 140 at the desired location on sidewalls 42 and 44 opposite from floor 100. For the embodiment shown in FIG. 4, temporary supporting jig 334 includes eight guide brackets 336. As shown in FIG. 5, guide brackets 336 are sized to fit over the upper surface of sidewalls 42 and 44 opposite from floor 100.

Upper load divider tracks 142 and 144 each have a plurality of securing brackets 146 for attachment to respective sidewalls 42 and 44 opposite from floor 100. Securing brackets 146 cooperate with each other to mount upper load divider assembly 140 on first composite box structure 40. For one application, tracks 142 and 144 are approximately forty feet in length. For other applications, tracks 142 and 144 may extend along the full length of the respective sidewalls 42 and 44.

For some applications, metal plates 148 are integrally molded adjacent to interior surface 52 of side walls 42 and 46 for use in providing a mechanical connection between brackets 146 and the respective side walls 42 and 44. As shown in FIG. 6, core 53 and multiple layers of fiber reinforced plastic are disposed around and between metal plate 148 and the exterior of composite box structure 30. This feature of the present invention substantially reduces heat transfer between the interior and exterior of the resulting composite box structure 30. Metal plates 148 are preferably wrapped with one or more layers of fiber material prior to infusion with the selected resin to form a more secure bond with other portions of the respective side walls 42 and 44. Brackets 146 may also be adhesively bonded with respective portions of side walls 42 and 44. Guide brackets 336 are used to ensure alignment between brackets 146 and their respective metal plates 148.

Various types of mechanical fasteners may be inserted between each bracket 146 and its respective metal plate 148. The mechanical fastener may include blind threaded rivets 150 and nuts 152. A wide variety of blind rivets, bolts and other fasteners may be satisfactorily used with the present invention. Examples of such fasteners are available from Huck International, Inc. located at 6 Thomas, Irvine, Calif. 92718-2585. Power tools satisfactory for installing such fasteners are also available from Huck International and other vendors.

For other applications, brackets 146 may be integrally molded as part of the respective side walls 42 and 44. This embodiment of the present invention would allow molding composite box structure 30 with roof 120 formed as an integral part thereof. Tracks 142 and 144 would be installed on brackets 146 after mounting composite box structure 30 on railway car underframe 200.

Portions of lower load divider track assembly 170 are shown in FIGS. 3, 7, 8A, 8B and 9. Lower load divider track assembly 170 includes a pair of tracks 172 and 174 disposed respectively within first longitudinal recess 62 and second longitudinal recess 64. First longitudinal recess 62 is formed in interior surface 51 of side wall 42 located above interior surface 101 of floor 100. Second longitudinal recess 64 is formed in interior surface 51 of side wall 44 located above interior surface 101 of floor 100. Tracks 172 and 174 extend generally parallel with each other, tracks 142 and 144 and floor 100.

As best shown in FIG. 7, each track 172 and 174 and the corresponding longitudinal recesses 62 and 64 have portions disposed on opposite sides of the respective openings 46. For example, first longitudinal recess 62 in sidewall 42 preferably includes first recess portion 62*a* disposed on one side of opening 46 and second recess portion 62*b* formed on the opposite side of the respective opening 46. A first portion of track 172 is disposed in first recess portion 62*a*. A second portion of track 172 is disposed in second recess portion 62*b*. Second track 174 and second longitudinal recess 64 are similarly disposed in sidewall 44 on opposite sides of the respective opening 46.

First longitudinal recess 62 is sized to receive first track 172 and to maintain a generally flush interior surface on the respective sidewall 42. In a similar manner, second longitudinal recess 64 is sized to receive second track 174 and to also maintain a generally flush interior surface on sidewall 44.

Upper load divider track assembly 140 and lower load divider track assembly 170 are aligned with each other to allow satisfactory operation of load divider panel assembly 162 including rollers 164 in the respective tracks 142 and 144. Similarly, alignment with lower load divider track assembly 170 is necessary to ensure satisfactory operation of sprockets 166 in lower tracks 172 and 174. Proper alignment of upper load divider track assembly 140 with lower load divider track assembly 170 results in easy movement of load divider panel assembly 162 along tracks 142, 144, 172 and 174. After upper load divider assembly 140 and lower load divider assembly 170 have been aligned with each other, temporary supporting jig 334 may be removed from first track 142 and second track 144. Lever 168 is used to move load divider panel assembly 162 longitudinally within interior 32 of composite box structure 30 and to releasably secure load divider panel assembly 162 with lower load divider track assembly 170 at a desired location within interior 32.

Figure 8A:
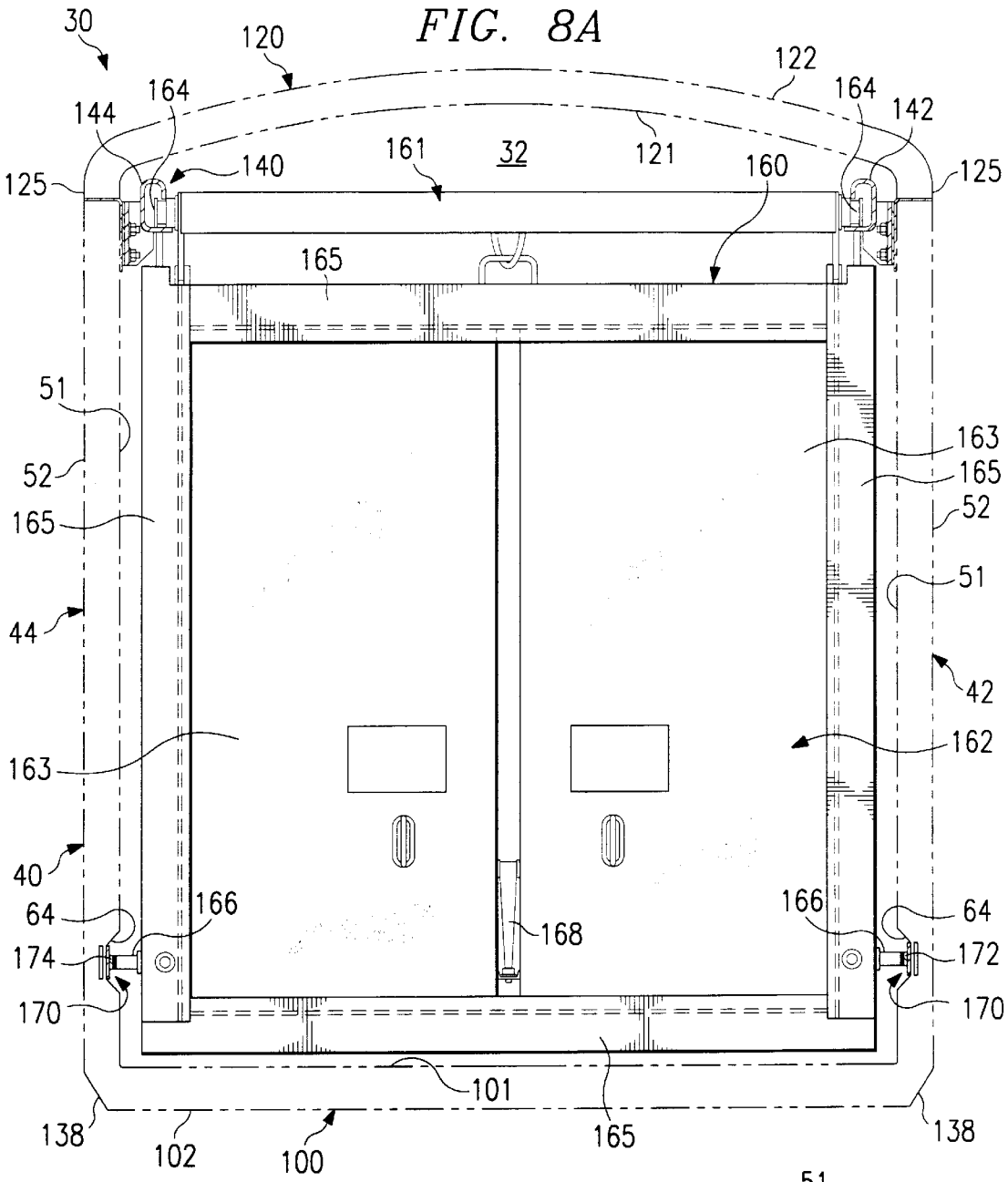
FIG. 8A is a schematic drawing in section with portions broken away showing an interior view of a composite box structure with a load divider system incorporating one aspect of the present invention.

As shown in FIG. 8A, load divider panel assembly 162 preferably includes a pair of load divider panel 163 having a generally rectangular configuration. Load divider panels 163 are disposed within metal frame 165 which is in turn attached to carriage assembly 161 and lower load divider track assembly 170. For one application, load divider panels 163 are preferably formed from fiber reinforced plastic. For other applications, load divider panels 163 may be formed from composite materials having a foam core encapsulated with layers of fiber reinforced plastic such as shown in FIG. 2.

Figure 8B:
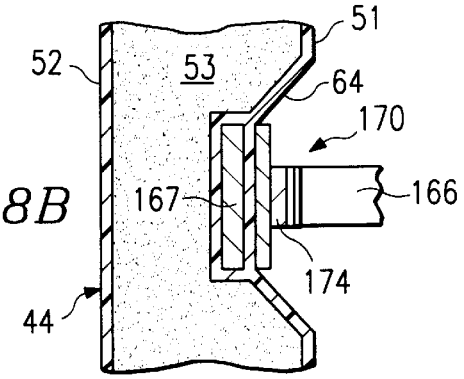
FIG. 8B is an enlarged schematic drawing in section with portions broken away showing details of the attachment between a lower load divider track and portions of the adjacent side wall.

FIG. 8B is an enlarged drawing showing support plate 167 which has been integrally molded within side wall 44 adjacent to second longitudinal recess 64 for use in attaching portions of second track 174. Various mechanical fasteners (not expressly shown) may be used to attach second track 174 with supporting plate 167 in the same manner as previously described with respect to attaching brackets 146 and support plates 148. Each support plate 167 is preferably wrapped with one or more plies of fiber material prior to infusion with the selected resin.

Figure 10:
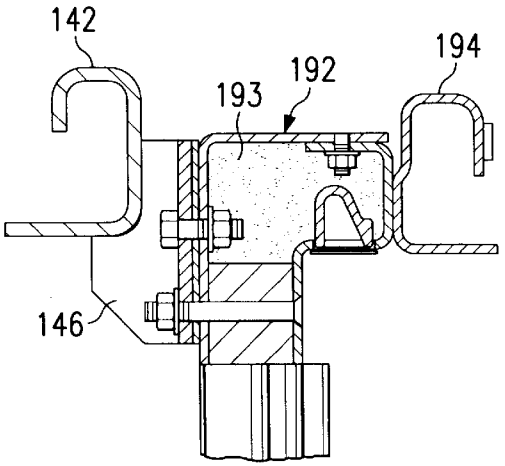
FIG. 10 is a schematic drawing in section with portions broken away showing a door header or door retainer mounted in an opening of the composite box structure taken along lines 10—10 of FIG. 9.

As shown in FIGS. 1A, 7 and 9, metal reinforcing frame or door frame assembly 190 is attached to the perimeter of each opening 46 in respective sidewalls 42 and 44. Each door frame assembly 190 includes a pair of vertical members 191 and door header or door retainer 192. Upper door track 194, lower door track 196 and threshold 198 are also installed adjacent to each door frame assembly 190. Vertical frame members 191 are attached to sections 48 of each sidewall 42 and 44 on opposite sides of the respective opening 46. Door header 192 is disposed between vertical frame members 191 at the top of each opening 46. As shown in FIG. 10, door header 192 has a generally hollow rectangular configuration and is preferably filled with foam insulation 193.

A pair of metal gussets 291 are preferably attached to the lower portion of each vertical frame member 191 adjacent to respective portions of side sills 242 and 244. Gussets 291 provide structural support for the respective vertical beam members 191 and other components of door frame assembly 190. Gussets 291 also protect sidewalls 42 and 44 during operation of the respective doors 180. Layer 292 of fiber reinforced plastic is preferably formed on the interior surface of each vertical frame member 191. Vertical frame members 191 preferably have a generally hollow configuration which has been filled with foam insulation 293.

Figure 12:
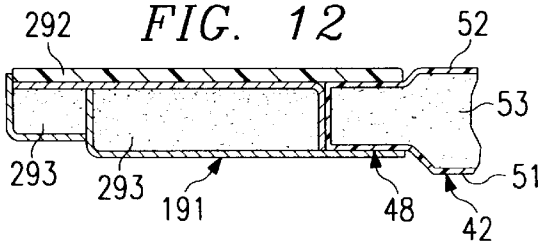
FIG. 12 is a drawing in section with portions broken away showing portions of a door frame assembly and adjacent portions of a side wall at an opening in the composite box structure taken along lines 12—12 of FIG. 9.

For one application, sidewalls 42 and 44 have a nominal thickness of approximately five inches. As shown in FIGS. 3 and 12, section 48 of sidewalls 42 and 44 adjacent to the respective openings 46 have a nominal thickness of approximately two and one-half inches. Vertical frame members 191 and layer 292 of fiber reinforced plastic also have a combined thickness of approximately two and one-half inches which results in a flush interior surface 52 on sidewalls 42 and 44 adjacent to respective openings 46. The thickness of vertical frame members 191 may vary between two inches and three inches and the width may vary from fourteen inches to fifteen inches. The junction between vertical frame members 191 and the associated door header 192 is a highly stressed area. Therefore, relatively thick reinforcing plates 298 are preferably installed at each corner between door retainer 192 and vertical frame members 191.

The variation in thickness of sidewalls 42 and 44 adjacent to respective openings 46 provides an offset to receive the respective plug door 180. A corresponding offset is also formed in the portion of floor 100 adjacent to each opening 46. The resulting offset at each opening 46 accommodates door frame assembly 190 and particularly vertical frame members 191 to allow the associated plug door 180 and its operating mechanism to fit within the desired AAR clearance envelope. For one application, the offset provided by door frame assembly 190 and floor 100 allowed increasing the length of railway box car 20 by approximately six feet to seven feet.

Figure 13:
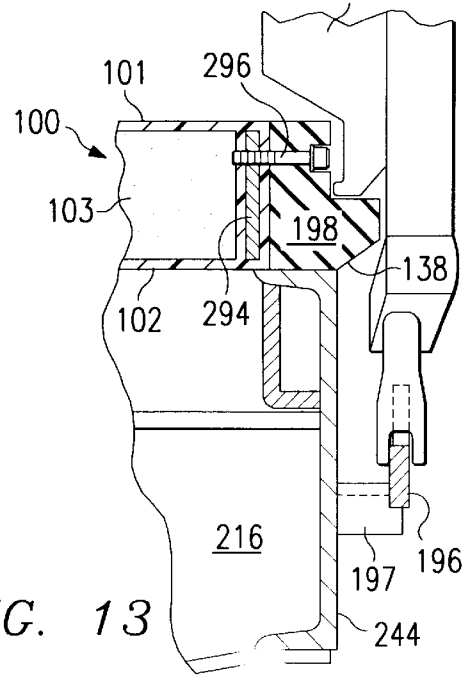
FIG. 13 is a drawing in section with portions broken away showing the lower portion of a door at an opening in the composite box structure with an elastomeric threshold taken along lines 13—13 of FIG. 9.
Figure 11:
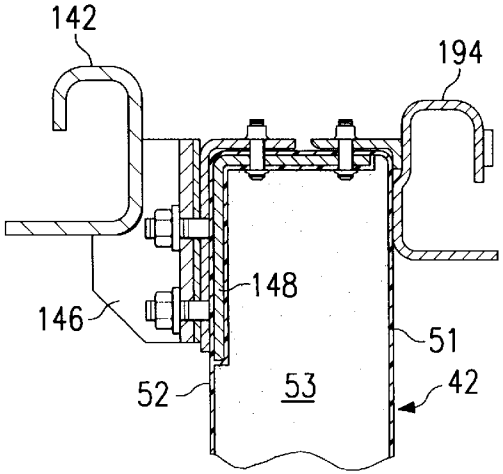
FIG. 11 is a schematic drawing in section with portions broken away showing a side wall with portions of an upper door track mounted on the exterior surface of the side wall and portions of an upper load divider track assembly mounted on the interior surface of the side wall taken along lines 11—11 of FIG. 9.

As shown in FIG. 13, floor 100 includes an offset adjacent to each opening 46. Metal plate 294 is integrally molded in floor 100 adjacent to each opening 46. An elastomeric threshold 198 is preferably disposed within the lower portion of each opening 46 adjacent to floor 100. As shown in FIG. 13, bolts 296 are used to attach elastomeric threshold 198 to plate 294. Also, adhesive bonding may be provided between elastomeric threshold 198 and floor 100. Each elastomeric threshold 198 is preferably disposed on the portion of side sills 242 or 244 adjacent to the respective opening 46.

For some applications, threshold 198 may be formed from steel alloys, aluminum alloys, ceramic materials, and/or composites of these materials. Alternatively, threshold 198 may be formed by integrally molding an appropriately sized metallic plate or ceramic plate as an integral part of floor 100. For the embodiment shown in FIG. 13, threshold 198 may be replaced if desired. For other applications, threshold 198 may be integrally molded as part of composite floor structure 100.

An elastomeric gasket (not shown) may be formed on the interior of each plug door 180 adjacent to the perimeter of the respective door 180. The elastomeric gasket is located to contact adjacent portions of door frame assembly 190 when the respective door 180 is in its first position. The elastomeric gasket and elastomeric threshold 198 cooperate with each other to minimize heat transfer between the interior and the exterior of composite box structure 30 when the respective door 180 is in its first position.

As shown in FIG. 8A, chamfered surfaces 138 are preferably formed on the exterior of composite box structure 30 at the junction of floor 100 and respective sidewalls 42 and 44. Chamfered surfaces 138 extend parallel with each other along both sides of composite box structure 30 adjacent to railway car underframe 200. Each elastomeric threshold 198 includes a corresponding chamfered surface 138. Chamfered surfaces 138 are provided to allow increasing the length of the resulting railway box car 20 while fitting within the desired AAR clearance envelope.

A pair of door stops 181 and 182 are preferably mounted on the exterior of each side wall 42 and 44 to limit the movement of the associated sliding plug door 180 from its first position to its second position. Door stops 181 and 182 are both adhesively bonded and mechanically attached to the respective sidewalls 42 and 44. Support plates 72 as shown in FIGS. 9 and 14 are preferably disposed in selected vertical supporting beams 156 at the appropriate location in sidewalls 42 and 44. Mechanical connections as previously described for securing brackets 146 may be formed between door stops 181 and 182 and support plates 72 in the appropriate vertical support beam 56.

Rubber bumpers 184 are preferably formed on the end of each door stop 181 and 182 to contact edge 183 of the respective door 180. For some applications it may be satisfactory to install only one door stop 181 on each side wall 42 and 44. For other applications more than two door stops 181 and 182 may be installed on the exterior of each sidewall 42 and 44.

Door stops 185 and 186 are preferably provided on vertical frame member 191 opposite from door stops 181 and 182 to limit the movement of door 180 from its second open position to its first close position.

For some applications, ladders 206 and safety equipment such as hand brakes 208 are attached to railway car underframe 200. For other applications, appropriate support plates may be molded within composite box structure 30 to allow attaching ladders 206 and/or safety equipment such as hand brakes 208 to the exterior of the associated composite box structure 30.

Following attachment of various components associated with load divider system 160 and door frame assemblies

190, an appropriate adhesive may be placed on the top of end walls 82 and 84 and side walls 42 and 44 opposite from floor 100. Roof 102 is then mounted on side walls 42 and 44 and end walls 82 and using a crane and spreaders (not shown). Straps (not shown) may then be applied to maintain close contact between roof 120 and first composite body 40 until the desired adhesive bond has been achieved.

The following specifications are for railway boxcar 20 incorporating one embodiment of the present invention.

| | |
|---|---|
| Outside length | 68 feet 0 inches |
| Inside length | 67 feet 2 inches |
| Distance between center line of railway trucks | 50 feet 0 inches |
| Outside width of composite box structure | 10 feet 0 inches |
| Inside width | 9 feet 2 inches |
| Height from rail to top of car | 15 feet 6 inches |
| Inside height from floor to roof | 11 feet ½ inches |
| Height of door opening | 9 feet 6½ inches |
| Width of door opening | 12 feet 0 inches |
| Internal volume with load dividers | 6,170 cubic feet |
| Internal volume without load dividers | 6,291 cubic feet |
| Light weight | 86,000 pounds |
| Nominal load carrying capacity | 200,000 pounds |
| Total gross rail load | 286,000 pounds |

Although the present invention and its advantages have been described in detail, it should be understood that various changes, substitutions and alterations can be made herein without departing from the spirit and scope of the invention as defined by the following claims.

What is claimed is:

1. A railway boxcar comprising:

a pair of opposite side walls and a pair of opposite end walls extending between the side walls to define in part a hollow interior for the boxcar;

a door mounted on each side wall intermediate the end walls;

a floor extending between the side walls and the end walls;

the side walls, the end walls, and the floor formed as a first fiber reinforced composite unit;

the first fiber reinforced composite unit mounted on a railway car underframe;

a second fiber reinforced composite unit forming a roof for the boxcar;

an upper load divider track assembly having a pair of tracks with one track disposed between the roof and one side wall and the other track disposed between the roof and the other side wall; and a lower load divider track assembly having a pair of tracks with a first track disposed within a first longitudinal recess formed within an interior surface of one side wall and a second track disposed within a second longitudinal recess formed within an interior surface of the other side wall.

2. The railway boxcar of claim 1 further comprising:

a generally rectangular opening formed in each side wall with each door mounted adjacent to one of the respective openings and each door sized to block thee respective opening to control access to the interior of the boxcar; and a vertical frame member attached to portions of each side wall adjacent to the respective openings.

3. The railway boxcar of claim 1 further comprising;

a generally rectangular opening formed in each side wall intermediate the end walls;

the respective openings extending from the roof to the floor;

a vertical frame member attached to portions of each side wall adjacent to the respective openings; and a metal gusset mounted on the exterior of each side wall and attached to both the lower portion of each vertical frame member and to adjacent portions of an underframe of the railway boxcar to provide structural support for the respective vertical frame member.

4. The railway boxcar of claim 1 further comprising:

a generally rectangular opening formed in each side wall with one of the doors mounted adjacent to the respective opening in each side wall with each door sized to block the respective opening;

a vertical frame member attached to portions of each side wall adjacent to the respective openings;

a door header disposed between and attached to respective vertical frame members at the top of each opening;

a threshold attached to the floor at each opening;

each threshold extending between the lower portion of the respective vertical frame members; and each threshold formed from material selected from the group consisting of elastomers, steel alloys, aluminum alloys, fiberglass reinforced plastic and composites of these materials.

5. The railway boxcar of claim 1 wherein the lower load divider track assembly further comprises:

the first longitudinal recess formed in the one side wall having a first recess portion disposed on one side of the respective opening and a second recess portion disposed on the opposite side of the respective opening;

the second longitudinal recess formed in the other side wall having a first recess portion disposed on one side of the respective opening and a second recess portion disposed on the other side of the respective opening;

the first track having a first track portion mounted in the first recess portion of the first longitudinal recess and the first track having a second track portion mounted in the second recess portion of the first longitudinal recess; and the second track having a first track portion mounted in the first recess portion of the second longitudinal recess and the second track having a second track portion mounted in the second recess portion of the second longitudinal recess.

6. The railway boxcar of claim 1 wherein each door further comprises:

a first layer of fiber reinforced plastic to define in part an interior surface for the door;

a second layer of fiber reinforced plastic to define in part an exterior surface for the door; and a plurality of foam blocks disposed between the first layer of fiber reinforced plastic and the second layer of fiber reinforced plastic.

7. The railway boxcar of claim 1 wherein the lower load divider track assembly further comprises:

the first longitudinal recess and the first track sized to maintain a flush interior surface with the one side wall; and the second longitudinal recess and the second track sized to maintain a flush interior surface with the other side wall.

8. The railway boxcar of claim 1 further comprising:

a load divider panel disposed within the interior of the railway boxcar extending between the one side wall and the other side wall;

the load divider panel movably mounted on the upper load divider track assembly; and the load divider panel releasably secured to the lower load divider track assembly, whereby the position of the load divider panel may be varied within the interior of the railway boxcar.

9. The railway boxcar of claim 8 wherein the load divider panel further comprises a composite fiberglass structure mounted in a metal frame.

10. The railway boxcar of claim 1 further comprising:

a plurality of securing brackets attached to each of the tracks of the upper load divider assembly;

a plurality of metal plates integrally molded within each sidewall; and each securing bracket mechanically attached respectively to one of the metal plates.

11. A railway boxcar comprising:

a pair of opposite side walls and a pair of opposite end walls extending between the side wall to define in part a hollow interior for the boxcar;

a generally rectangular opening formed in each side wall with a door mounted on each side wall adjacent to the respective opening for use in controlling access to the interior of the boxcar;

a floor extending between the sidewalls and the end walls;

the side walls, the end walls, and the floor formed as a first fiber reinforced composite unit;

a second fiber reinforced composite unit attached to the end walls and the side walls opposite from the floor to form a roof for the boxcar;

a door frame assembly attached to portions of each side wall adjacent to the respective opening;

each door having a first layer of fiber reinforced plastic to define in part an interior surface for the door;

a second layer of fiber reinforced plastic to define in part an exterior surface for the door;

a foam core encapsulated in fiber reinforced plastic and disposed between the first layer of fiber reinforced plastic and the second layer of fiber reinforced plastic; and each door having a first position in which the door blocks the respective opening to form a thermal barrier between the interior and exterior of the boxcar and a second position which allows access to the interior of the boxcar.

12. The railway boxcar of claim 11 further comprising:

a threshold attached to portions of the floor at each opening;

each threshold extending between lower portions of vertical frame members of the door frame assembly; and each threshold formed from material selected from the group consisting of elastomers, steel alloys, aluminum alloys, fiberglass reinforced plastic and composites of these materials.

13. The railway boxcar of claim 11 further comprising:

an upper load divider track assembly disposed between the roof and the side walls; and a lower load divider track assembly mounted on the interior of the side walls above the floor.

14. The railway boxcar of claim 11 further comprising:

each opening having a door header mounted between opposite portions of the respective side wall and adjacent to the roof; and an upper door track attached to the exterior of each door header to allow longitudinal movement of the door between the first position blocking access to the interior of the boxcar and the second position allowing access to the interior of the boxcar.

15. The railway boxcar of claim 11 further comprising:

the roof having a pair of longitudinal edges which extend along opposite sides of the railway boxcar;

each edge of the roof located at a first height above the floor;

each side wall having a second height which is approximately equal to the first height between the corresponding edge of the roof and the floor;

the opening formed in each side wall extending vertically from the floor to the corresponding edge of the roof; and an upper door track attached to and extending along each edge of the roof for use in slidably mounting the respective door on each side wall.

16. The railway boxcar of claim 15 further comprising a door retainer attached to each door header and extending along the exterior of each sidewall for use in slidably mounting the respective door on the exterior of the sidewall.

17. An insulated railway boxcar comprising:

a pair of opposite side walls and a pair of opposite end walls extending between the side walls to define in part a hollow interior for the boxcar;

a door mounted on each side wall intermediate the end walls for use in controlling access to the interior of the boxcar;

a floor extending between the side walls and the end walls;

the side walls, the end walls, and the floor integrally molded with each other to form a first fiber reinforced composite unit;

a second fiber reinforced composite unit molded to form a roof for the boxcar;

the roof being attached to the end walls and the side walls of the first fiber reinforced composite unit opposite from the floor to form a composite box structure;

an upper load divider track assembly having a pair of tracks with a first track disposed between the roof and one side wall and the second track disposed between the roof and the other side wall;

a lower load divider track assembly having a pair of tracks with one track mounted within a first longitudinal recess formed within one side wall and the other track mounted within a second longitudinal recess formed in the other side wall;

a generally rectangular opening formed in each side wall with each door slidably mounted adjacent to one of the respective openings and each door sized to block the respective opening; and a vertical door frame member attached to a portion of each side wall adjacent to the respective opening.

18. The railway boxcar of claim 17 further comprising:

a metal gusset attached to each vertical frame member and adjacent portions of an underframe of the railway boxcar to provide structural support for each vertical frame member.

19. The railway boxcar of claim 17 further comprising at least one door stop mounted on the exterior of each side wall to limit longitudinal movement of the respective door with respect to the opening in the side wall.

20. The railway boxcar of claim 17 further comprising a pair of door stops mounted on the exterior of each side wall to limit longitudinal movement of the respective door with respect to the opening in the side wall.

21. The railway boxcar of claim 17 wherein each side wall further comprises:

a plurality of first foam blocks wrapped with fiber material;

the first foam blocks disposed vertically with respect to each other to form a section of the respective side wall;

a plurality of second foam blocks wrapped with fiber material and disposed vertically between adjacent sections of the first foam blocks to provide a plurality of internal vertical support beams for the respective side wall;

a first layer of fiber material disposed on the exterior of the foam blocks and a second layer of fiber material disposed on the interior of the foam blocks;

the fiber material impregnated with a resin to encapsulate the foam blocks in fiber reinforced plastic and to provide a fiber reinforced plastic exterior surface and a fiber reinforced plastic interior surface for the respective side wall; and at least one door stop attached to at least two of the internal vertical support beams of the respective side wall.

22. The railway boxcar of claim 21 further comprising at least two door stops attached to at least two of the internal vertical support beams of the respective side wall.

23. An insulated railway boxcar comprising:

a structural supporting underframe having a plurality of interconnected longitudinal frame members having upper surfaces and a composite box structure supported on the upper surfaces of the longitudinal frame members of the underframe, the composite box structure having a pair of opposite sidewalls and a pair of opposite end walls extending between the side walls to define in part a hollow interior for the boxcar;

a generally rectangular opening formed in each side wall with a door mounted on each side wall adjacent to the respective opening for use in controlling access to the interior of the boxcar;

a floor extending between the side walls and the end walls, the floor having a lower surface supported on the upper surfaces of the longitudinal frame members of the underframe;

a roof extending between the side walls and the end walls opposite from the floor;

the side walls, the end walls, the floor and the roof each having a first layer of fiber reinforced plastic to define in part an interior surface for the boxcar;

the side walls, the end walls, the floor and the roof each having a second layer of fiber reinforced plastic to define in part an exterior surface for the railway boxcar;

a foam core disposed between the first layers of fiber reinforced plastic and the second layers of fiber reinforced plastic;

a chamfer formed on each side of the exterior of the boxcar and extending along the length of the boxcar at the junction between the floor and the respective side wall; and an offset provided in the floor at each opening to receive a portion of the door therein.

* * * * *